US006151899A

United States Patent [19]

Park

[11] Patent Number: 6,151,899

[45] Date of Patent: Nov. 28, 2000

[54] GAS-TURBINE ENGINE COMBUSTOR

[75] Inventor: Roger James Park, Lincoln, United Kingdom

[73] Assignee: Alstom Gas Turbines Limited, United Kingdom

[21] Appl. No.: 09/306,574

[22] Filed: May 6, 1999

[30] Foreign Application Priority Data

May 9, 1998 [GB] United Kingdom ..... 9809829

[51] Int. Cl.[7] ..... F02C 1/00

[52] U.S. Cl. ..... 60/748; 60/737; 60/746; 60/748

[58] Field of Search ..... 60/748, 737, 746, 60/743, 750; 239/398, 405, 400; 431/115, 116, 353, 350, 349, 285, 278, 187, 263

[56] References Cited

U.S. PATENT DOCUMENTS

| | | | |
|---|---|---|---|
| 4,023,351 | 5/1977 | Beyler et al. | 60/39.74 |
| 4,054,028 | 10/1977 | Kawaguchi | 60/39.23 |
| 4,569,295 | 2/1986 | Skoog . | |
| 4,718,359 | 1/1988 | Skoog . | |
| 5,319,935 | 6/1994 | Toon et al. | 60/733 |
| 5,450,724 | 9/1995 | Kesseli et al. . | |

FOREIGN PATENT DOCUMENTS

| | | |
|---|---|---|
| 0093572A1 | 11/1983 | European Pat. Off. . |
| 0 114 062 A2 | 7/1984 | European Pat. Off. . |
| 0276398A2 | 8/1988 | European Pat. Off. . |
| 0 728 989 A2 | 8/1996 | European Pat. Off. . |
| 2044431A | 10/1980 | United Kingdom . |
| 2214630A | 9/1989 | United Kingdom . |
| 2316162A | 2/1998 | United Kingdom . |

*Primary Examiner*—Charles G. Freay
*Assistant Examiner*—William Rodriguez
*Attorney, Agent, or Firm*—Kirschstein, et al.

[57] ABSTRACT

A lean-burn combustor for a gas-turbine engine has a radial inflow pre-mixing, pre-swirling burner with a central burner face which forms the upstream wall of a pre-chamber of the combustor. A circular recess is formed in the burner face, the recess having at least one pilot fuel injector for introducing pilot fuel tangentially into the recess, whereby the burner runs cooler and combustion characteristics are improved.

8 Claims, 4 Drawing Sheets

GAS-TURBINE ENGINE COMBUSTOR

FIELD OF THE INVENTION

This invention relates to a gas-turbine engine combustor of the lean-burn type.

BACKGROUND TO THE INVENTION

As efforts are made to decrease the production of polluting nitrogen oxides from gas turbine engines, use is made of so-called lean burn pre-mix combustors in which the fuel to air ratio is reduced as far as possible in the higher operating range. This has disadvantages which the present invention seeks to reduce. Firstly, in combustors with radial inflow pre-mixing burners which impart a high degree of swirl to a primary lean fuel/air mixture before feeding it into an axial flow pre-chamber in flow series with a main combustion chamber, a re-circulating vortex core flow of hot combustion gases, extending between the burner and the main combustion chamber, can impinge on the burner face, leading to high surface temperatures which may reduce the working life of the component material in that region. Secondly, the weak fuel/air mixture leads to a problem in maintaining flame stability when the engine load is reduced, leading to the need to use fuel-rich pilot-flame systems or other means for changing the fuel/air ratio at low engine loads. Such approaches typically lead to an increase in harmful emissions, and may require a more complicated and expensive design of combustor.

SUMMARY OF THE INVENTION

According to the invention, there is provided a lean-burn combustor for a gas-turbine engine, the combustor having in flow series a radial inflow premixing burner, an axial flow combustion pre-chamber and an axial flow main combustion chamber of larger cross-sectional area than the pre-chamber, the burner comprising:

a fuel and air mixing device located radially outwardly of the pre-chamber for mixing primary fuel and air before the resulting fuel and air mixture enters the pre-chamber, the mixing device being adapted to impose on the fuel and air mixture entering the pre-chamber a motion having a vigorous swirling component about an axial centerline of the prechamber, and a burner face located radially inwardly of the fuel and air mixing device and forming an axially upstream wall of the pre-chamber, the burner face incorporating pilot fuel injection means for injection of pilot fuel into the pre-chamber, wherein during operation of the combustor an axial re-circulating vortex core flow of gases extends between the burner face and an upstream part of the main chamber, wherein the pilot fuel injection means is disposed within a recess in the burner face, which recess is substantially circular in plan view, the pilot fuel injection means being adapted to inject pilot fuel into the recess in a substantially tangential direction with respect to the circular form of the recess, whereby operating temperatures of the burner face are reduced and combustion characteristics are improved.

The recess may be generally cylindrical, comprising a peripheral wall and a base wall. Preferably a radiused corner profile is provided between the cylindrical wall and the base wall. The injection means preferably comprises at least one injector arranged to introduce the fuel adjacent the peripheral wall.

Alternatively, the recess may be formed as a continuously-curved profile.

It is preferred that the diameter of the recess is approximately equal to a diameter of the re-circulating vortex core flow of fuel and air mixture at the burner face, whereas the depth of the recess should be less than its diameter, being suitably of the order of 30% of its diameter. This diameter will vary according to the design of the mixing device, but the circulation pattern in the combustion gases at this point for this type of combustor is well-recognized among those skilled in the art.

Primary fuel may be introduced into the air flow through the fuel and air mixing device at any convenient location, or at a plurality of locations, to ensure that fuel/air mixing is as efficient as possible. In particular, fuel may be introduced where air enters the mixing device, and/or downstream thereof. The fuel introduced may be gaseous or liquid, and the different types of fuel may be introduced in different regions of the mixing device.

It has been found that the provision of the recess in the burner surface results, surprisingly, in a reduction in the operating temperature of the burner face, offering the possibility of extended life for the burner. Additional benefits are believed to be better low load emissions and improved low load flame stability with lean burn running. It is believed that these benefits may arise, at least in part, from the establishment of a secondary circulation of cooler inflowing gases from the fuel and air mixing device over the burner face and into the recess. The cooling effect may be enhanced by the introduction of fuel within the recess.

BRIEF DESCRIPTION OF THE DRAWINGS

Exemplary embodiments of the invention will now be described with reference to the accompanying drawings, in which:

FIG. 1(*b*) is a view on section B-B in FIG. 1(*a*);

DETAILED DESCRIPTION OF THE PREFERRED EMBODIMENTS

Figure 1A:
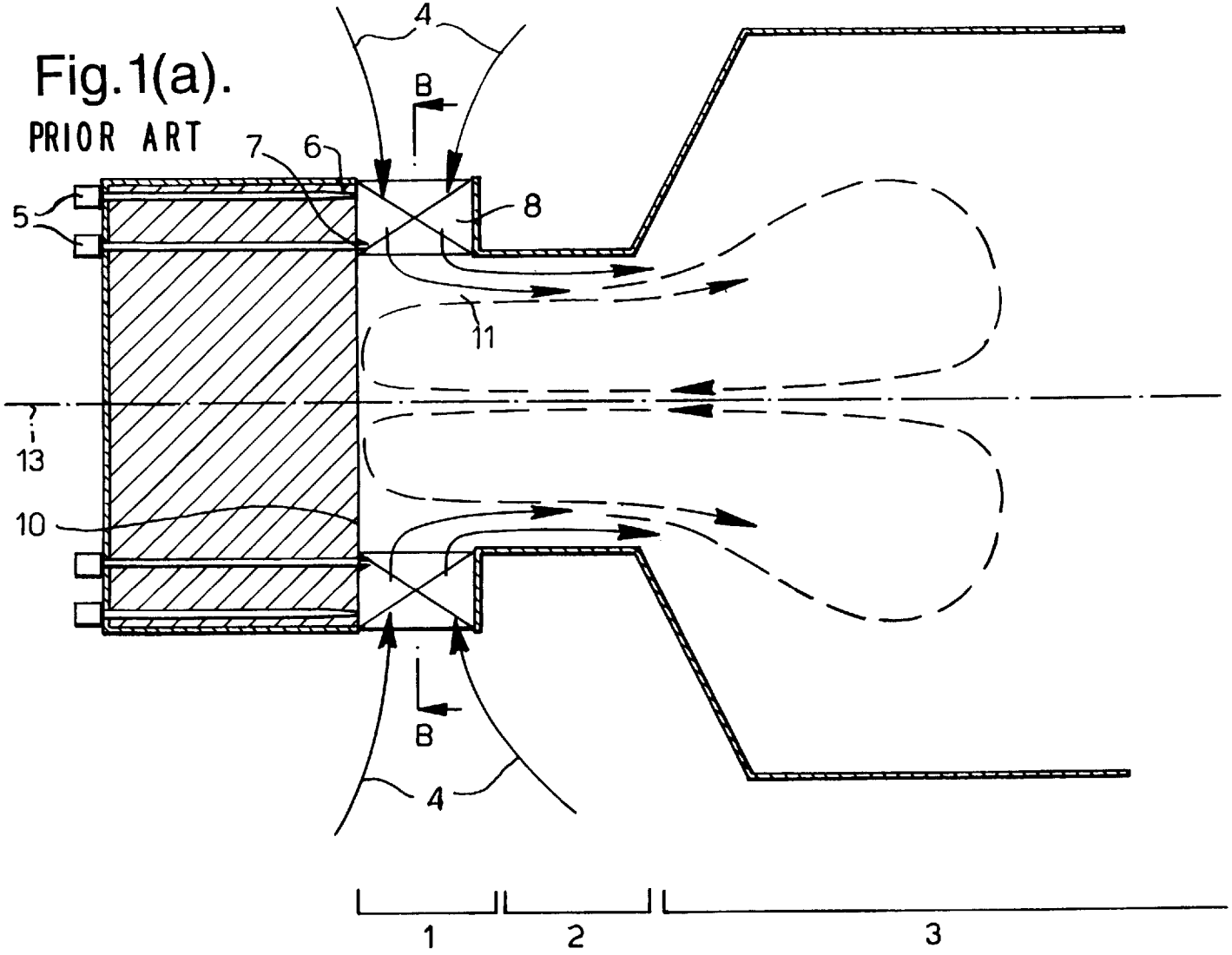
Fig.1(a). PRIOR ART
FIG. 1(*a*) is a sectional elevation of part of a known prior art lean-burn combustor provided with a radial inflow premixing burner.
Figure 1B:
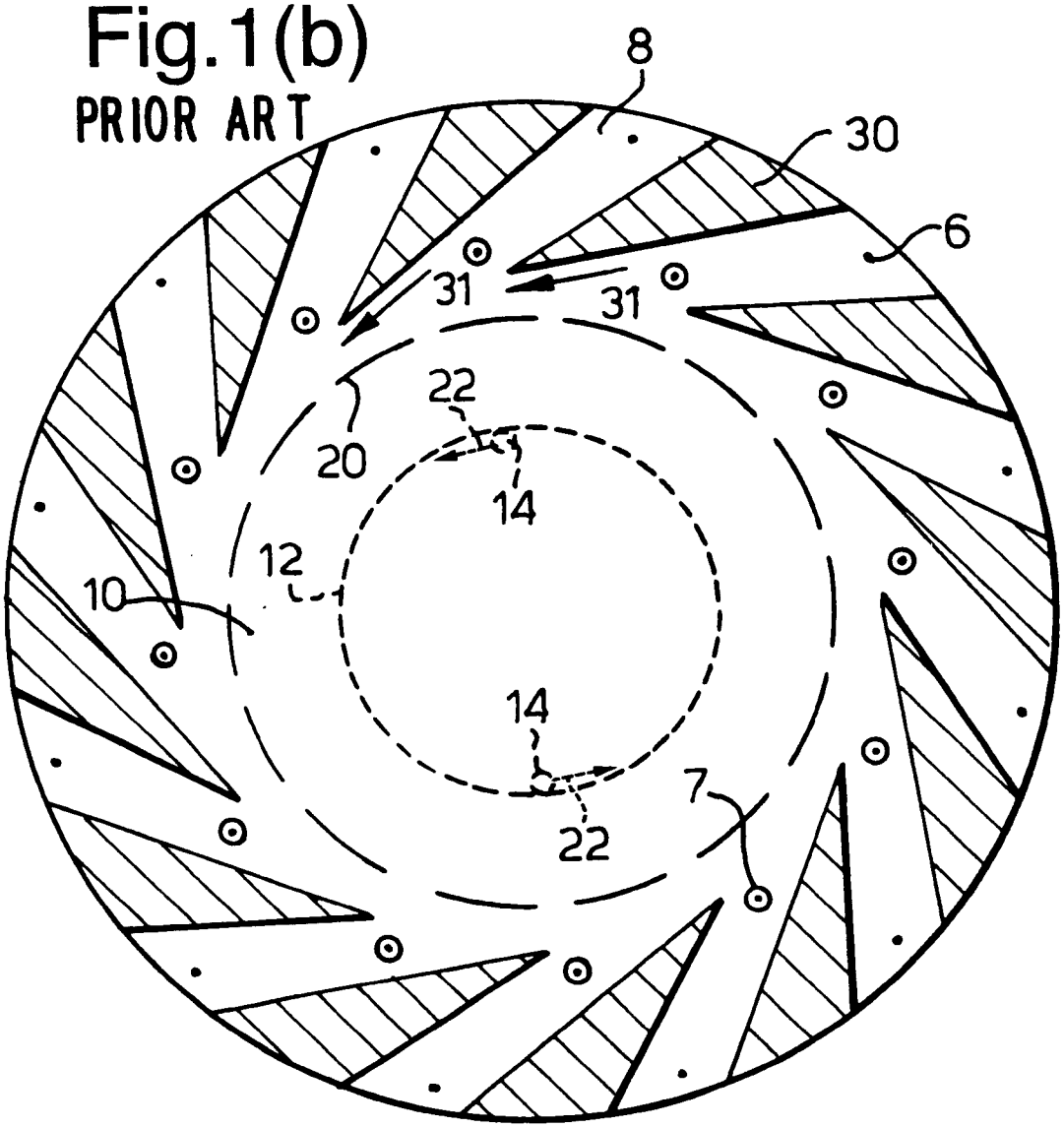
Fig.1(b) PRIOR ART

Referring first to FIGS. 1(*a*) and l(*b*), the prior art combustor has a fuel/air mixer 1 of the radial inflow swirler type, a combustor pre-chamber 2 of circular cross-section and a combustor main chamber 3, only the upstream portion of which is shown. The main chamber 3 is of significantly larger diameter and length than the pre-chamber 2. Air 4 is supplied to the mixer 1 under pressure from a compressor of the gas turbine engine (not shown), and fuel is supplied under pressure to fuel injectors 6 and/or 7 via connectors 5. Air moves inwardly through swirler passages 8 defined between triangular vanes 30 and mixes with the fuel injected into the airflow from injectors 6 and/or 7. The swirler passages 8 are oriented tangentially of the pre-chamber 2 and hence, as shown by the arrows 31 in FIG. 1(*b*), impart a rotational component of motion to the inward flow of air, so that upon exiting the passages 8, the fuel/air mixture has a vigorous anticlockwise swirling motion about the centerline 13 of the swirler and the pre-chamber. It would of course be possible to obtain a clockwise swirling motion using an opposing tangential orientation of the swirler passages 8.

The air/fuel mixture is initially ignited by electric spark igniter means situated in some convenient position within the combustor (for example, in the burner face 10), and the flame is maintained thereafter through a re-circulating vortex core flow of gases which results from the overall design of the combustor. The re-circulating vortex core flow, and with it the flame, extends downstream towards and into the main combustion chamber 3. By following the direction of the arrows in FIG. 1(*a*) it can be seen that an axial re-circulating flow of gases is achieved because the air/fuel mixture exiting the swirler passages 8 with radially inward and rotational components of motion comes under the influence of an axial pressure-drop through the pre-chamber 2 and the main chamber 3. At some point within an upstream part of the main chamber 3, the combination of the axial and rotational flow causes the flow of fuel/air mixture and other gases to turn inwards toward the swirler center axis 13, and then proceed in axial counter-direction towards the burner face 10, where it turns outwards and meets the incoming flow from the swirler passages. In this manner, the internal re-circulating vortex core flow is established. Where the internal re-circulating flow meets the incoming flow from the swirler passages 8, a region of much turbulence is created and this region is called the shear layer 11.

To aid in ignition of the engine and for low load conditions, burner face 10 can also incorporate one or more pilot fuel injectors, not shown in FIG. 1(*a*). Pilot fuel injected from burner face 10 is used to create a region of richer fuel/air mixture in the circulation pattern of the gases within the pre-chamber 2, with the object of stabilizing combustion at the above-mentioned conditions.

For a fuller description of this type of combustor, the prior British Patent Application No. GB9901797.2 corresponding to pending U.S. Pat. application Ser. No. 09/240,245, filed Jan. 29, 1999, and commonly owned by the same assignee as the instant application should be consulted, and is hereby incorporated herein by reference.

Figure 2:
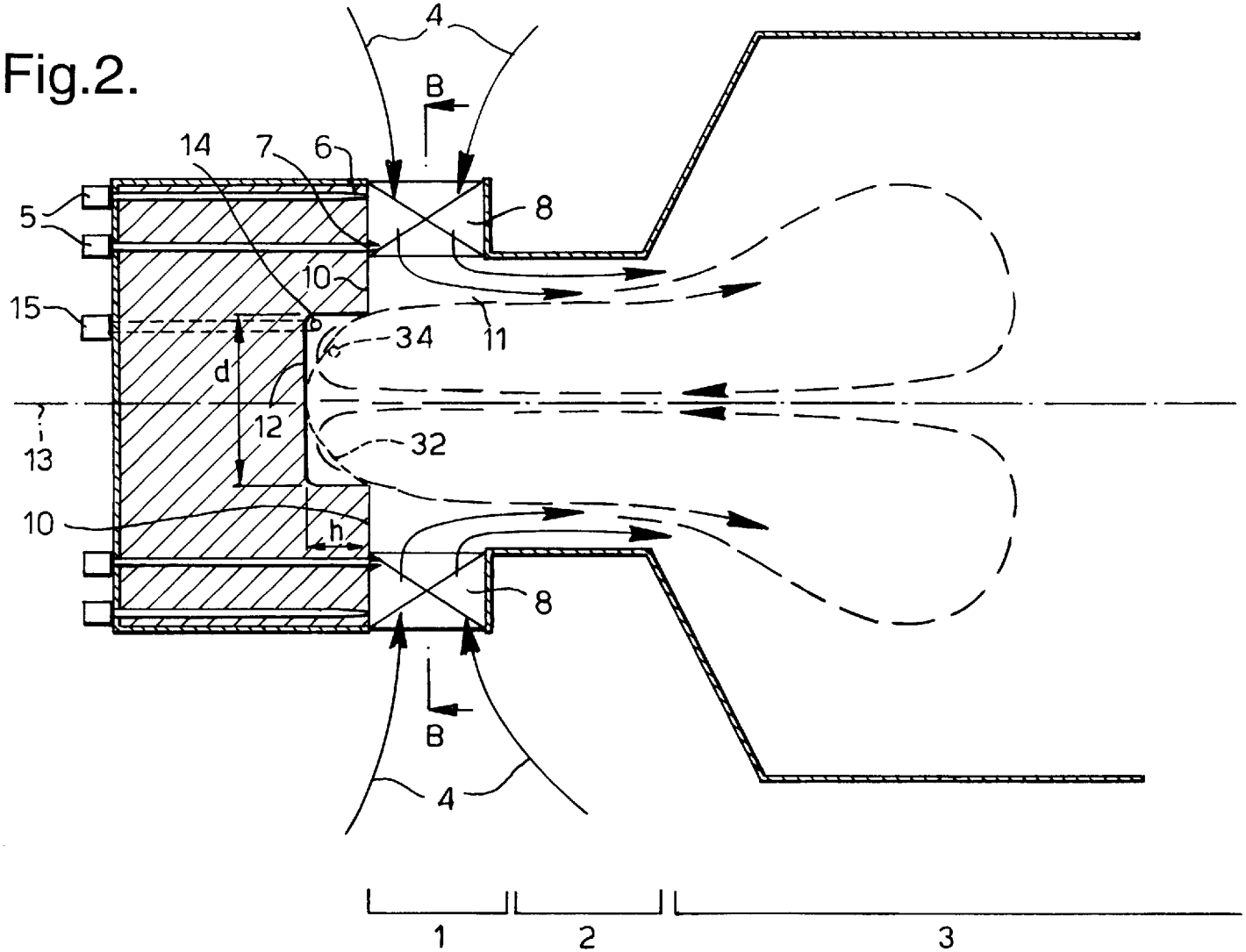
FIG. 2 is a view similar to FIG. 1(*a*) of a lean-burn combustor according to the invention.
Figure 3:
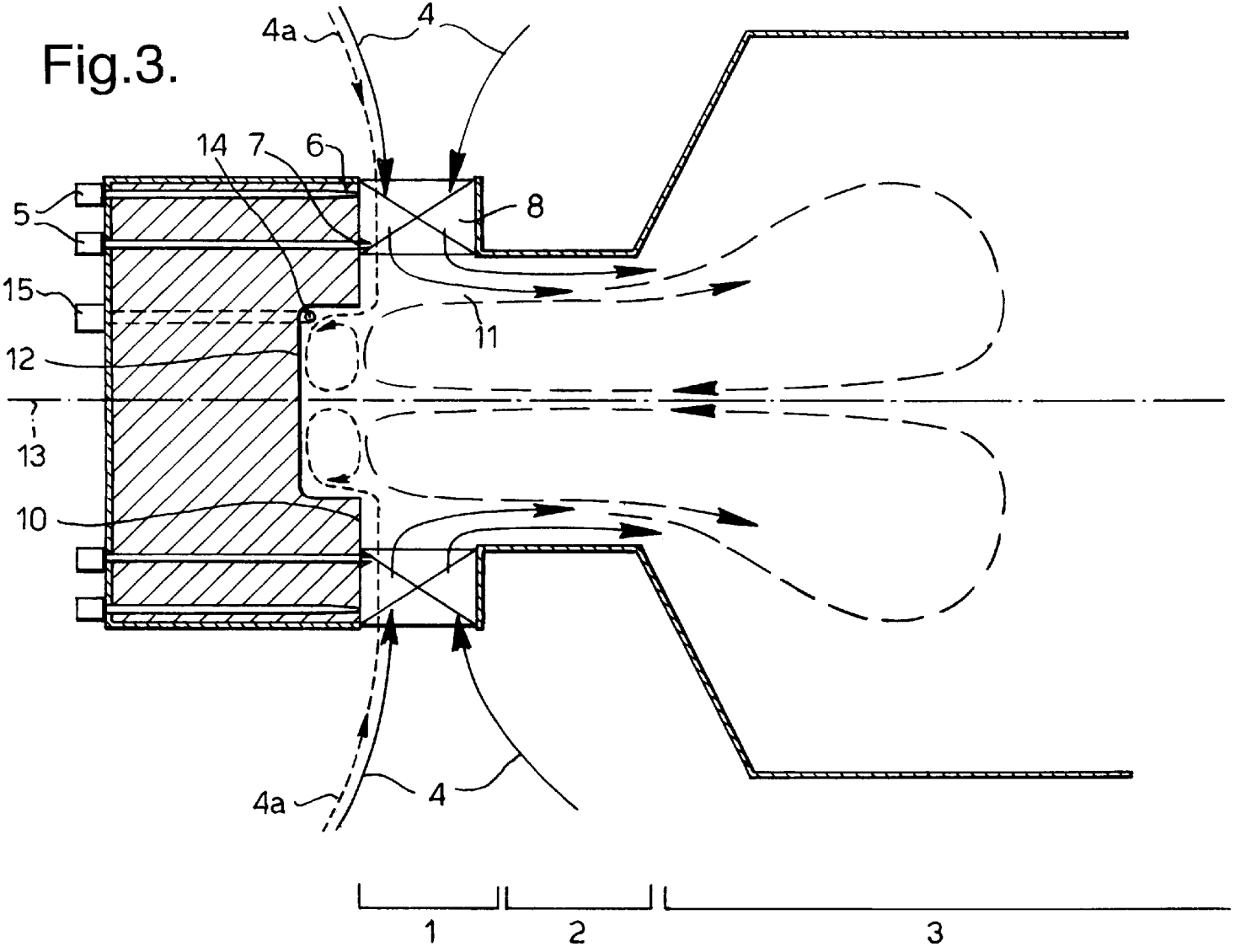
FIG. 3 is essentially the same view as in FIG. 2, but showing a possible alternative gas flow pattern within the combustor.

Referring now also to FIGS. 2 and 3, in which like components to those in FIG. 1(*a*) bear the same reference numerals, the burner face 10 is provided with a circular recess 12 arranged centrally thereof. The location of recess 12 is also indicated in FIG. 1(*b*) by a dashed circle. As will be seen if the above-mentioned patent specification is consulted, it is known to provide the burner face 10 in FIG. 1(*a*) with a lip at its periphery which defines a shallow recess centrally of the face into which pilot fuel is injected in the axial direction, this pilot fuel then being subject to an air-blast directed radially inwards across the pilot fuel injection points by the lip. The position of this lip is indicated in FIG. 1(*b*) by the circular broken line 20.

However, in the present invention, at least one pilot fuel injector 14, supplied with fuel via connection 15, is set into the recess 12 at such a position and orientation that the fuel is injected substantially tangentially into the recess so as to flow around the peripheral wall thereof. FIG. 1(*b*) indicates two diametrically opposite pilot fuel injectors as small dashed circles 14, but there may be three, four or more such injectors equiangularly spaced around the recess 12. Such injectors may possibly take the form of short hollow tubes projecting from the base of the recess 12. One such is indicated in FIG. 2. Such tubes will be closed at their distal ends but provided with one or more small apertures in their sides, the apertures being positioned to project corresponding jets of pilot fuel in a tangential direction corresponding to the direction of swirl of the re-circulating vortex core flow, as indicated by arrows 22 in FIG. 1(*b*). Alternatively, subject to satisfactory test results, the pilot fuel jets 22 may be directed in a direction opposite (in the present case, clockwise) to the direction of swirl of the re-circulating vortex core flow.

After injection into the recess 12, the fuel from the pilot injector or injectors is carried by the circulation flow into the shear layer 11, where thorough mixing occurs, to such an extent that a stable combustion reaction is established therein which gives flame stability at quite low fuel to air ratios (of the order of 1 to 500 by mass). In addition, because of the low fuel content the levels of pollutants generated are low. The recess 12 has a diameter d similar to that of the burner re-circulating vortex core flow at that point.

As shown in FIGS. 2 and 3, the recess is generally cylindrical, but is also provided with a radiused corner profile between the cylindrical wall and the base wall of the recess.

Alternatively, the recess may be formed as a continuously-curved profile, for example part of a spherical surface, or with an elliptical profile, the latter being illustrated by dashed line 32 in FIG. 2. As also shown in FIG. 2, one or more fuel injectors 34 are provided at a suitable point on the continuous profile, at a depth intermediate the top and bottom of the recess 32.

The depth of the recess 12 or 32 is preferably less than its diameter, but is substantially deeper than the recess defined by the peripheral burner lip shown in the above-mentioned U.S. Pat. application Ser. No. 09/240,245. A suitable depth for the recess is of the order of 30% of its diameter.

FIG. 3 illustrates a possible flow pattern achieved in the recess which may give rise to the beneficial effects seen in the use of the combustor of the invention. The main re-circulating system is as illustrated in FIG. 2, but a small proportion of the incoming gases from the swirler passages 8, illustrated by the broken line 4*a*, follows the contour of the burner face to the recess 12, where it enters the recess, flowing inwardly over the surface of the recess until meeting in the center, where the flow re-circulates radially outwards over the radially inward-moving flow, thereby establishing a secondary circulating flow within the recess. This results in a constant flow of cooler incoming gases washing over the burner face and over the surface of the recess 12, acting as a coolant and a film cooling barrier against heat convection from the combustion flame. It will be seen that, with such a flow, the cooling effect of introducing fuel into the recess may be secondary to that of the incoming cool gases from the inlet. Another possible mechanism involves the flow of air 4*a* over the face of the burner simply diffusing into the main re-circulating vortex core flow, which in this case extends from the pre-chamber 2 into the recess 12 as shown in FIG. 2. In any case, however, a cooling effect is achieved in the recess.

The above described cooling effect extends the operating life of the burner face and is likely to give benefits in respect of flame stability and the lowering of pollution when operating with low fuel to air mixture ratios.

I claim:

1. A lean-burn combustor for a gas-turbine engine, the combustor having, in flow series, a radial inflow premixing burner, an axial flow combustion pre-chamber having a cross-sectional area and an axial centerline, and an axial flow main combustion chamber having a larger cross-sectional area than the pre-chamber, the burner comprising:

a) a fuel and air mixing device located radially outwardly of the pre-chamber for mixing primary fuel and air before a resulting fuel and air mixture enters the pre-chamber, the mixing device being adapted to impose on the fuel and air mixture entering the pre-chamber a motion having a vigorous swirling component about the axial centerline of the pre-chamber;

b) a burner face located radially inwardly of the fuel and air mixing device and forming an axially upstream wall of the pre-chamber, the burner face incorporating pilot fuel injection means for injection of pilot fuel into the pre-chamber;

c) whereby, during operation of the combustor, an axial re-circulating vortex core flow of gases extends between the burner face and an upstream part of the main chamber; and d) the pilot fuel injection means being disposed within a recess in the burner face, the recess being substantially circular in plan view, the pilot fuel injection means being adapted to inject the pilot fuel into the recess in a substantially tangential direction with respect to the circular recess, whereby operating temperatures of the burner face are thereby reduced and combustion characteristics improved.

2. The combustor according to claim 1, wherein the recess is generally cylindrical and comprises a peripheral wall and a base wall.

3. The combustor according to claim 2, wherein a radiused corner profile is provided between the cylindrical wall and the base wall of the recess.

4. The combustor according to claim 2, wherein the injection means comprises at least one injector arranged to introduce the pilot fuel adjacent the peripheral wall of the recess.

5. The combustor according to claim 1, wherein the recess is formed as a continuously-curved profile.

6. The combustor according to claim 1, wherein the recess has a diameter which is approximately equal to a diameter of the re-circulating vortex core flow of gases at the burner face.

7. The combustor according to claim 1, wherein the recess has a depth which is less than a diameter of the recess.

8. The combustor according to claim 7, wherein the depth of the recess is of the order of 30% of the diameter of the recess.

* * * * *